United States Patent [19]

Bueno

[11] 4,392,268

[45] Jul. 12, 1983

[54] CHALKBOARD ERASER CLEANER SYSTEM

[76] Inventor: Victor M. Bueno, 708 Opelousas Ave., Algiers, La. 70114

[21] Appl. No.: 330,687

[22] Filed: Dec. 14, 1981

[51] Int. Cl.[3] ..... A47L 25/00

[52] U.S. Cl. ..... 15/91

[58] Field of Search ..... 15/5, 21 R, 89, 91

[56] References Cited

U.S. PATENT DOCUMENTS

| | | | |
|---|---|---|---|
| 667,540 | 2/1901 | Little | 15/91 X |
| 715,705 | 12/1902 | Stutt et al. | 15/91 |
| 906,983 | 12/1908 | Adams | 15/91 |
| 2,874,398 | 2/1959 | Di Persio | 15/89 X |

*Primary Examiner*—Edward L. Roberts

*Attorney, Agent, or Firm*—C. Emmett Pugh

[57] ABSTRACT

A chalkboard eraser cleaner including a completely closeable, box-like housing containing an electrically driven, rotatable beater. At the top of the container is a side, slot-like opening with a door for the insertion of the eraser to be cleaned. Right below the area in which the eraser is inserted, there is an eraser support surface of somewhat slack, mesh netting material supported between the walls of the container for supporting the eraser during beating, with the mesh netting located directly above the rotatable beater whose arms impact the bottom of the eraser through the mesh netting to clean the eraser. Below the beater and the mesh is a removable drawer located at the bottom of the container which can be removed for the disposal of the eraser dust, which generally will fall into the drawer during use of the cleaner. An electrical contact switch is positioned in the container adjacent to the forward end of the area in which the eraser to be cleaned is inserted. After the eraser is initially inserted into the side, slot-like opening, the hinged door is then used to further push in the eraser, and, as the front end of the eraser hits and closes the electrical contact switch, the electric motor receives power and the beater is rotated by the electric drive, causing the eraser to be cleaned.

9 Claims, 3 Drawing Figures

CHALKBOARD ERASER CLEANER SYSTEM

BACKGROUND OF THE INVENTION

1. Field of Invention

The present invention relates to a chalkboard, for example a blackboard, eraser cleaner system including a closeable container in which is preferably contained an electrically driven beater for the cleaning of or chalk dust removal from the eraser.

2. Prior Art

In schools and the like, it is common, traditional practice to have black/greenboards or other chalkboards for use by the teachers in the teaching process. For removal of the chalk-written information on the board, hand manipulated erasers have been provided for many years to remove the chalk from the boards. This results of course in the erasers in due course becoming saturated with the chalk dust, causing the need to clean the erasers for further use.

In the past, it has been common practice for the students to clean the erasers by hitting them together or against a wall to cause the chalk dust to be propelled into the air and thus removed from the erasers. This obviously has been a very messy, time-consuming and unsatisfactory approach.

There have been a number of attempts in the prior art to attempt to provide more sophisticated tools for the cleaning process.

Various prior art patents which disclose or describe chalk board eraser cleaners are listed below:

| Patentee(s) | Pat. No. | Issue Date |
|---|---|---|
| T. Adams | 906,983 | Dec. 15, 1908 |
| G. A. Marshall | 1,540,996 | June 9, 1925 |
| J. F. Palmer | 1,757,545 | May 6, 1930 |
| J. C. Mather | 1,985,939 | Jan. 1, 1935 |
| F. L. Hennefer | 2,163,788 | June 27, 1939 |
| F. M. Schaefer | 2,306,911 | Dec. 29, 1942 |
| F. L. Hennefer | 2,323,908 | July 13, 1943 |
| J. M. Di Persio | 2,874,398 | Feb. 24, 1959 |
| F. L. Hennefer | 2,896,234 | July 28, 1959 |
| G. J. Dalton | 3,395,413 | Aug. 6, 1968 |

Some of the prior art devices have utilized non-motorized approaches, such as for example the Dalton patent (U.S. Pat. No. 3,395,413) in which the eraser is hand manipulated back-and-forth over an opening in contact with a weighted scrubber-beater which swings back-and-forth as the eraser is moved; and the Di Persio patent (U.S. Pat. No. 2,874,398) which uses a box in which the eraser is placed on a spring mounted, relatively rigid screen platform, with the box being shaken vigorously to cause the eraser to be shaken and knocked about in the box with the dust falling through the screened platform.

A manually, hand cranked version of a eraser cleaner is shown in the Adams patent (U.S. Pat. No. 906,983), which provides a completely closeable box having a door through which the eraser is positioned on a rigid trough or shelf and is held in position by a spring wire rod as the eraser is cleaned by the beating action of cleaner fingers. A bottom door is included for removal of the collected chalk dust.

However, most of the prior art devices utilize electrically driven motorized cleaners in which the eraser being cleaned is hand-held over an open slot beneath which is positioned a rotatable beater which, by impact against the bottom of the eraser held in the slot, cleans it; note the patents to Palmer (U.S. Pat. No. 1,757,545), Mather (U.S. Pat. No. 1,985,939), and Schaefer (U.S. Pat. No. 2,306,911). A similar approach is shown in the series of three Hennefer patents (U.S. Pat. Nos. 2,163,788; 2,323,908; and 2,896,234) except that reciprocating beaters are used rather than rotatable beaters.

In the Marshall patent (U.S. Pat. No. 1,540,996) a relatively large rotatable beater is rotated centrally within a cylindrical housing in which for example twelve erasers are fixedly positioned spaced along the inner periphery of the housing by channels plates.

However, all of these prior art devices have various problems and drawbacks associated with them.

Those which have open areas in which the erasers are positioned allow the dust to be expelled out into the area surrounding the cleaner, potentially dirtying the user of the cleaner. Additionally, these types, as well as others of the prior art, require that the user be in constant attendance at the cleaner in order to hold the eraser.

On the other hand, those that provide a completely closed container for the eraser and its cleaning elements during use, have mounted the eraser on a rigid shelf or in fixed positions, which accordingly required very precise positioning of the beater and did not allow for wearing of the beater after substantial use. Thus, after the beater had become worn from use, its cleaning action started to diminish. Additionally, in contrast to this prior art, allowing the eraser to have some movement during the cleaning operation enhances the effectiveness of the cleaning by its own kinetic motion and action as well as by positioning the eraser at different points with respect to the direct point of impact from the moveable beater.

The present invention overcomes all of the foregoing prior art problems, as well as others, and does so with a relatively straight-forward, compact, reliable, simple, inexpensive and portable device.

3. Summary Discussion of Invention

The present invention in its preferred embodiment provides a completely, closeable container or housing for the eraser and the cleaning elements during use and supports the eraser during use by flexible, for example, mesh netting, means positioned adjacent to a moveable, for example, rotatable, beater.

Additionally, for greatly simplified and ease of use, the eraser is inserted into the closeable container through a side, slot-like door, which is used to push the eraser into the container into engagement with a spring-biased electrical contact switch, causing the beater drive means to be activated. Upon completion of the cleaning operation, the door is merely opened, allowing the eraser to at least initially be ejected by the spring bias, breaking the electrical contact, and allowing easy removal of the eraser from the device.

At the bottom of the container, there is preferably provided a removeable drawer, which is positioned below the beater and collects the chalk dust during use for later removal and disposal of the chalk dust in bulk.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF PREFERRED EMBODIMENT

Figure 1:
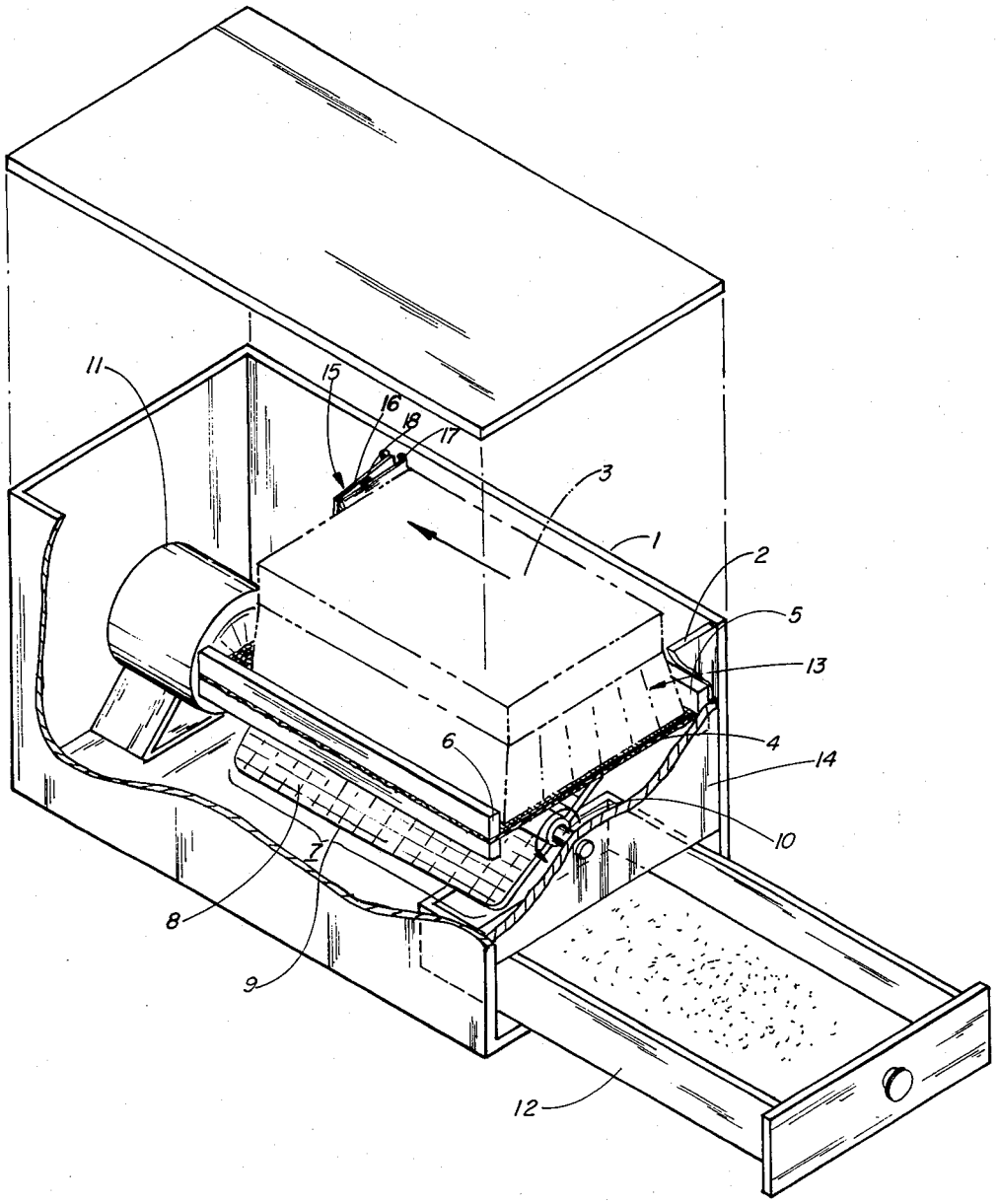
FIG. 1 is a partially exploded, perspective view, with portions cut away to show the interior elements, of the preferred embodiment of the chalkboard eraser cleaner system of the present invention.
Figure 3:
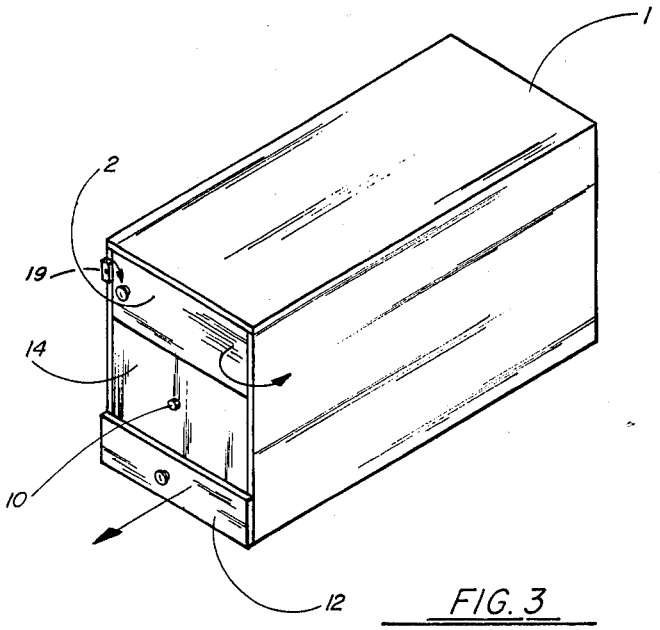
FIG. 3 is a perspective view of the embodiment of FIG. 1, similar to the perspective of FIG. 1, but from the opposite side.
Figure 2:
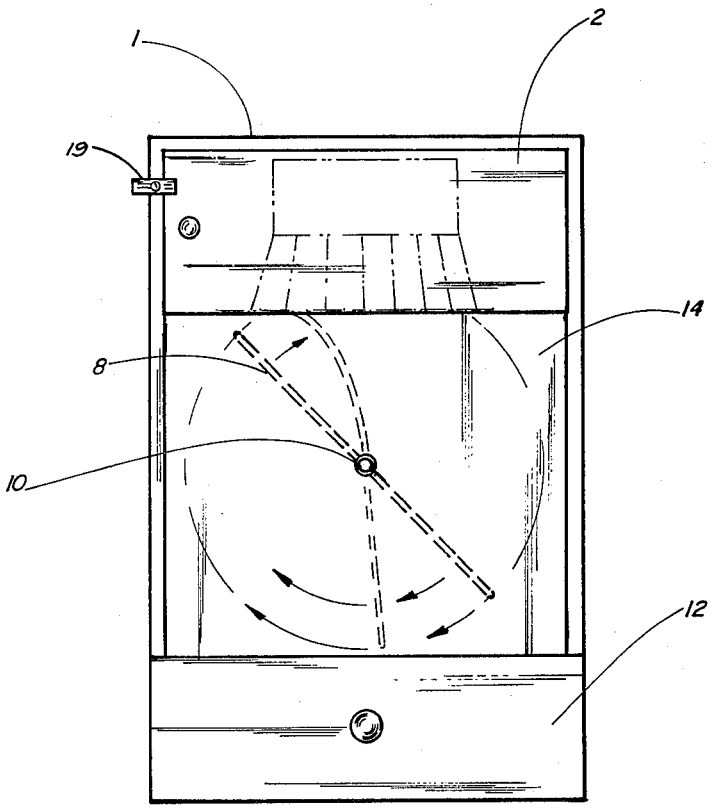
FIG. 2 is an end view of the embodiment of FIG. 1, with some of the internal elements shown in phantom line.

As illustrated in FIGS. 1 and 2, the preferred embodiment of the chalkboard eraser cleaner of the present invention comprises a completely closeable housing having a side, hinged door 2 allowing for the insertion and removal of the eraser 3 being cleaned.

During the cleaning operation, the eraser 3 occupies the position illustrated in FIG. 2. In this position, the eraser is supported on a somewhat moveable support surface of flexible, mesh netting material 4 which is attached to and suspended from the opposing side walls 5, 6. A small amount of slack is allowed to the mesh netting material 4 when it is attached to the walls 5, 6. The mesh netting material 4 provides a flexible, moveable support surface for the eraser during the cleaning operation, which allows a relatively slight but significant movement to the eraser 3 during its cleaning.

The netting 4 is positioned directly above and adjacent to the head portion 7 of a rotatable beater 8, which includes a series of peripherally spaced beater arms 9, which serve as impact members. The beater shaft 10 is connected to and forcefully moved and driven by an electric motor 11. The electric motor 11, which serves as drive means for the beater 8, can be battery driven from batteries included in the housing 1, if desired, or run off of exterior electrical power, for example, regular alternating current through a suitable power cord and plug (not illustrated).

Positioned below the beater head portion 7 of the beater 8 is a removeable drawer 12 located at the bottom of the housing or container 1. The drawer 12 serves as a collecting bin for the chalk dust which is removed from the cleaned erasers by the impact of the beater arms 9 against the underside of the erasers through the flexible mesh netting material 4. When filled, the drawer 12 is merely pulled out of the box-like housing 1 and dumped and then returned to the housing 1.

When it is desired to clean an eraser, the eraser 3 is initially inserted into the horizontally disposed, slot-like opening 13 in the end wall 14 (note FIG. 1), and the hinged door 2 then used to push inwardly against the back side, rear, exteriorly oriented end of the eraser 3, further moving it into the cleaning position illustrated in FIG. 2. As the eraser 3 is almost fully inserted, it comes into contact with the spring-biased electrical contact switch 15, causing the contact arms 16, 17, normally held apart by the spring 18, to come into contact, closing the electrical power circuit to the electric motor 11. (It should be understood that the phrase "spring-biased," when used in the context of this application, refers to any resilient biasing means which allows for regular movement of the arms 16, 17, together but causes them to spring or otherwise resiliently move out of contact under the resilient force of the biasing means.)

This causes the beater head portion 7 to rotate, bringing the beater arms 9 into forceful, impacting contact with the underside of the eraser 3 resting on the flexible, mesh netting material 4. This impact not only causes the chalk dust to be hit out of the eraser, but also causes the eraser to be moved up within the confines of the box-like housing 1, further assisting in the removal of the dust from the eraser 3. Additionally, because of the limited movement allowed to the eraser 3 due to the impact of the beater arms 9, the eraser will expose varying and different parts of its underside to the direct impact of the beater arms 9. All of this kinetic action of the eraser 3 significantly enhances the driving out of the chalk dust from it.

As the beater arms 9 continuously and cyclically impact the eraser 3, through the netting 4, the dust falls through the mesh netting material 4 and settles down into the collecting bin drawer 12. It is noted that during the cleaning operation, the box-like housing 1 is completely closed, and no significant dust is emitted to the exterior during this operation.

Additionally, it is noted that the door 2 can either be held in its closed position by the user during the cleaning operation, or, if desired, latched by means of exemplary latch 19 in its shut position, allowing unattended cleaning.

When the cleaning operating is completed, the door 2 is merely allowed to be opened by either unlatching it or removing the exterior pressure by the user on the outside of the door 2. With the door 2 in this openable disposition, the spring 18 causes the electrical contact arms to be disengaged, shutting off the electrical motor 11. Additionally, this spring bias causes the contact arm 16 to at least initially move and propel the eraser 3 out of the position shown in FIG. 2 so that it projects at least partially out from the slot opening 13 to the exterior of the housing 1. This allows for it to be easily grasped and then completely removed from the housing 1 to be replaced if needed or desired with another eraser to be cleaned.

An actual working proto-type has been built in accordance with the foregoing description, and it has worked quite satisfactorily and effectively. However, of course many variations in structure and approach are possible.

For example, rather than a rotatable beater, a reciprocating beater could be used, or, alternatively, brushes could be used. The entry door 2 and slot 13 could be positioned on the side rather than the top, and indeed two such side, vertically disposed slots could be used for the simultaneous cleaning of two, oppositely positioned erasers.

The exterior of the box-like housing 1 could be ornamental for appearance purposes; and/or could be made at least in part of transparent material (for example "LEXAN" plastic) to allow viewing of the eraser during operation to visually observe when cleaning was complete.

Also, particularly where visual access to the inside is present to determine when an eraser is completely cleaned or dusted, a slidable top for the drawer 12 could be provided to isolate the previously collected chalk dust during the cleaning operation for a subsequent eraser so that the collected dust is not subjected to the fanning and unsettling action of the internal air current generated by the rotating beater. When cleaning was complete and the motor 11 was off, the top could then be horizontally slid open against a side scraper, dumping the newly collected chalk dust into the drawer 12.

To limit or control or even eliminate the amount of movement of the eraser due to impact from the beater during cleaning, precisely positioned metal bands could be included around the top and sides of the area into which the eraser is inserted to hold it relatively fixed during cleaning, or, alternatively, a downwardly-spring-biased top could be used to control the eraser's movement. Sealing gaskets could be provided about the interiors of the door 2 and the exterior end of the drawer 12.

Rather than using an end, spring-biased electrical contact switch 15, an exteriorly positioned switch, for example, a push button or toggle switch could be used, although the combined switch and eraser ejector 15 is preferred in the most preferred embodiment. It is noted that a typical chalkboard eraser only weighs approximately two ounces, and has dimensions of one inch in width, two inches in height, and five inches in length. Because of this low weight, a weight sensing actuating switch would usually not be practical or cost effective. Thus, the combination of the laterally opposed door "pusher" 2 and the spring-biased switch-ejector 15 is most effective and preferred.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed is:

1. A chalkboard eraser cleaner, comprising:

an at least generally closed housing having wall portions;

a cylically moveable beater having impact members located in said container;

drive means associated with said beater for forcefully moving it; and flexible mesh netting means supported by said wall portions and located adjacent to and above said beater for supporting the chalkboard eraser while it is being cleaned by impacts from said beater when it is moved, said beater impact members impacting the underside of said flexible mesh netting means when said beater is forcefully moved by said drive means.

2. The eraser cleaner of claim 1, wherein there is further included:

opposed end wall portions forming with said side wall portions said container;

a horizontally disposed slot-like, entry-exit opening in a first one of said end wall portions, said netting means being position at the bottom of said slot-like opening and extending generally horizontally away therefrom into the interior of said housing.

3. The eraser cleaner of claim 2, wherein there is further included:

spring-biased means located adjacent to the interior, eraser supporting end of said netting means for contacting the interior end of the eraser when it is fully inserted into said housing through said entry-exit opening; and hinged door means for closing off said entry-exit opening and for contacting the rear, exteriorly oriented end of the eraser when it is inserted into said housing and engaging said spring-biased, said spring biased means at least initially pushing the eraser partially out of said housing when said door is opened.

4. The eraser cleaner of claim 3, wherein said drive means comprises an electrical motor; and wherein said spring-biased means also serves as an electric contact switch in line with the electric power source for said electric motor.

5. The eraser cleaner of claim 1, wherein there is further included:

chalk dust bin collecting drawer means located at the bottom of said housing below said netting means and said impact members for collecting and easily removing and disposing of the chalk dust collected during the cleaning of the erasers.

6. A chalk board eraser cleaner, comprising:

an at least generally closed housing having wall portions;

a cylically moveable beater having impact members located in said container;

drive means associated with said beater for forcefully moving it;

support means supported by said wall portions and located adjacent to said beater for supporting the chalk board eraser while it is being cleaned by impacts from said beater when it is moved, said beater impact members impacting the underside of the eraser when said beater forcefully moved by said drive means;

opposed end wall portions forming with said side wall portions said container;

a slot-like, entry-exit opening in at least a first one of said end wall portions, said support means being positioned adjacent the bottom of said slot-like opening and extending away therefrom into the interior of said housing;

spring-biased means located adjacent to the interior, eraser supporting end of said support means for contacting the interior end of the eraser when it is fully inserted into said housing through said entry-exit opening; and hinged door means for closing off said entry-exit opening and for contacting the exteriorly oriented part of the eraser when it is inserted into said housing and engaging said spring-biased, said spring biased means at least initially pushing the eraser partially out of said housing when said door is opened.

7. The chalkboard eraser cleaner of claim 6, wherein said drive means comprises an electrical motor; and wherein said spring-biased means also serves as an electric contact switch in line with the electric power source for said electric motor.

8. The chalkboard eraser cleaner of claim 6, wherein there is further included:

chalk dust bin collecting drawer means located at the bottom of said housing below said support means and said impact members for collecting and easily removing and disposing of the chalk dust collected during the cleaning of the erasers.

9. The eraser cleaner of claim 6, wherein said support means comprises flexible, mesh netting means supported by said side wall portions and located adjacent to and above said beater for supporting the chalk board eraser while it is being cleaned by impacts from said beater when it is moved, said beater impact members impacting the underside of said flexible, mesh netting means when said beater is forcefully moved by said drive means.

* * * * *